United States Patent [19]

Onal

[11] 3,981,626

[45] Sept. 21, 1976

[54] DOWN HOLE PUMP AND METHOD OF DEEP WELL PUMPING

[75] Inventor: Hasan F. Onal, Denver, Colo.

[73] Assignee: Sundstrand Corporation, Rockford, Ill.

[22] Filed: Feb. 6, 1975

[21] Appl. No.: 547,392

[52] U.S. Cl. ..... 417/89; 417/405

[51] Int. Cl.[2] ..... F04D 13/04; F04D 13/12

[58] Field of Search ..... 417/88, 89, 405, 406, 417/361, 391, 366, 379; 166/212, 187; 175/199; 415/1; 60/641

[56] References Cited

UNITED STATES PATENTS

| | | | |
|---|---|---|---|
| 1,535,697 | 4/1925 | Suczek | 417/88 |
| 1,610,454 | 12/1926 | Lawaczeck | 417/406 |
| 2,451,168 | 10/1948 | Lauman | 166/187 |
| 3,143,078 | 8/1964 | Gaslow | 417/406 |
| 3,171,355 | 3/1965 | Harris | 417/406 |
| 3,824,793 | 7/1974 | Matthews | 60/655 |
| 3,890,065 | 6/1975 | Eller et al. | 417/407 |
| 3,938,334 | 2/1976 | Matthews | 417/329 |

*Primary Examiner*—Carlton R. Croyle
*Assistant Examiner*—Louis J. Casaregola
*Attorney, Agent, or Firm*—Wegner, Stellman, McCord, Wiles & Wood

[57] ABSTRACT

A down hole pump and, more particularly, a turbine driven geothermal down hole pump has a housing insertable in a well casing to a depth wherein geothermal liquid is exposed to the inlet of the pump contained in the housing and with a turbine in the housing for driving the pump and which is supplied with a part of the pumped liquid which is filtered and returned under pressure as a power liquid for driving the turbine. The pump has a suction ejector supplied with spent power liquid received from the turbine for imposing a net positive suction head on liquid at the pump inlet and with this spent power liquid also being directed to an expansible seal surrounding a lower part of the housing to engage the seal with the well casing. The drive shaft between the turbine and the pump is rotatably mounted by journal bearings with power liquid returned from ground level being supplied by passages to the journal bearings in a manner to avoid packing and mechanical seals for the shaft.

3 Claims, 4 Drawing Figures

DOWN HOLE PUMP AND METHOD OF DEEP WELL PUMPING

The Government has rights in this invention pursuant to Grant No. AER 75-01620 awarded by the National Science Foundation.

BACKGROUND OF THE INVENTION

This invention relates to a down hole pump and, more particularly, to a turbine driven geothermal down hole pump capable of operating at a substantial depth in a geothermal well and which has reliable, long-life operation even when operating in a hot brine environment.

It is now known to pump hot brine in a temperature range of 350°F. to 650°F. from a geothermal well, which may be located 5,000–10,000 feet below ground level. The hot brine is pumped to a system including a heat exchanger wherein heat can be removed from the hot brine and used to power a system, such as a Rankine cycle system. This invention pertains to an improved design of a turbine driven pump for down hole operation.

DESCRIPTION OF THE PRIOR ART

A detailed discussion of a geothermal energy system is given in U.S. Pat. No. 3,757,516. However, the down hole pump disclosed therein does not disclose any of the solutions to the problems encountered in the field and which are solved by the structure disclosed herein.

Down hole turbine driven pumps are shown in Gaslow, U.S. Pat. No. 3,143,078, Harris U.S. Pat. No. 3,171,355, and Erickson U.S. Pat. No. 3,758,238. These patents do not show utilization of spent power liquid from the turbine for creating a net positive suction head at the pump inlet to prevent cavitation. This is particularly important in a geothermal well wherein the hot brine has dissolved solids and any tendency to cavitate, in effect, is a localized flashing resulting in precipitating out solids and the availability of oxygen for oxidation. Additionally, these patents fail to disclose a number of other important structural features for maximizing reliability and long-life operation for a down hole pump. There is reference in the Harris patent to a retractable casing seal. However, such structure does not have operating characteristics of the structure disclosed herein. There is reference in Erickson to the use of power liquid for lubricating bearings. However, the structure disclosed herein has significant improvements over that disclosed in Erickson.

SUMMARY

A primary feature of the invention disclosed herein is to provide a down hole pump and, more particularly, a turbine driven geothermal down hole pump capable of reliable, long-life operation at a substantial well depth and in a hot brine environment.

Another feature of the invention is to provide a pump as defined in the preceding paragraph wherein part of the pumped liquid is filtered and returned under pressure to provide power liquid for driving the turbine of the pump and with this power liquid performing a number of functions including pressurized lubrication of journal bearings for the shaft connecting the turbine and pump impeller to avoid the necessity for packing and mechanical seals which would be destroyed by solids in the hot brine.

In the pressurized lubrication of the journal bearings the power liquid either before entry into the turbine or after exit therefrom is still under pressure sufficient for delivery to the shaft journals, with the lowermost journal being at a level above the pump impeller and with the lubricating flow moving along the shaft to a collection chamber which is exposed to the action of the pump impeller whereby a pressure gradient is established to maintain the collection chamber at a sufficiently low pressure whereby lubricating liquid may freely enter the chamber.

Additional important features resulting from utilization of the power liquid returned to the turbine include utilization of the spent power liquid to provide an inlet pressure at the inlet to the pump impeller sufficient to result in a net positive suction head which prevents cavitation at the pump inlet and which, therefore, prevents localized flashing. The spent power liquid is also utilized to extend an expansible casing seal at the lower end of the pump housing and which includes a plurality of elastic rings normally of a size to have an outer diameter less than the inner diameter of the well casing to permit free movement of the pump housing down to the substantial depth in the well casing for actual use of the pump and, when power liquid is delivered to the turbine, a plurality of pressure operated pistons engageable with the rings are moved outwardly to expand the elastic rings into sealing contact with the well casing.

Another improvement in the pump structure disclosed herein relates to a multi-section pump housing, with sections being joined to an annular diffuser surrounding the pump impeller with the pump impeller mounted on an end of the pump shaft. Releasable means interconnect the housing sections and the diffuser whereby the housing may be disassembled to permit interchange or substitution of a different pump impeller and diffuser for changing of the parts to provide a differing pump performance without major modification.

DESCRIPTION OF THE PREFERRED EMBODIMENT

Figure 1:
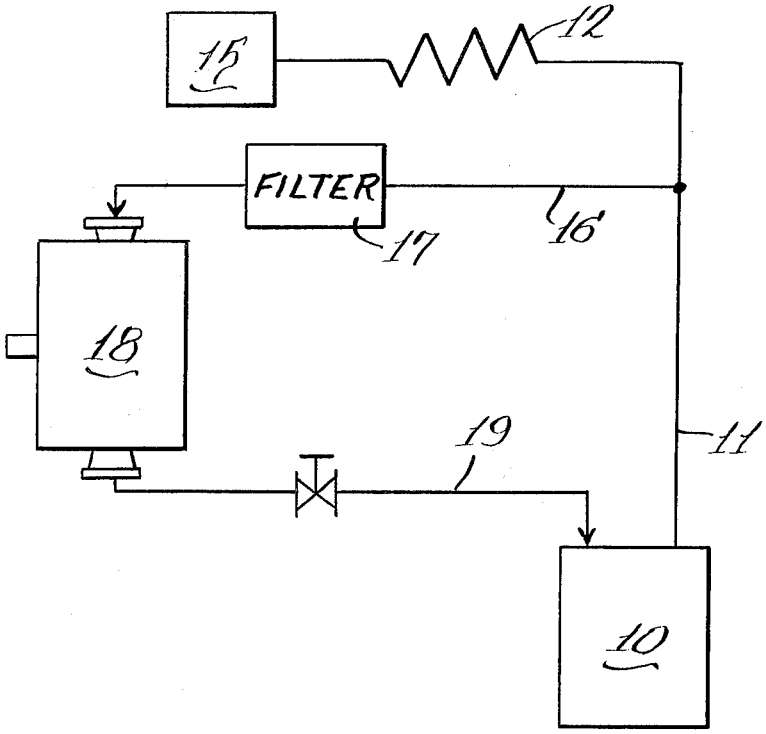
FIG. 1 is a schematic view of a geothermal energy system using the turbine driven geothermal down hole pump disclosed herein.

A geothermal energy system is, in part, shown in FIG. 1 wherein a well 10 provides a source for hot brine which is pumped from the well to a line 11. A major part of the hot brine passes through a heat exchanger 12 for removal of substantial heat therefrom for use in an energy system and with the outflow from the heat exchanger passing to a collection point 15 for disposal in a suitable manner. A fraction of the flow from the well, such as 20%, is directed through a line 16 in advance of the heat exchanger 12 and through a filter 17 for delivery to a motor driven pump 18 having an output connected to a line 19. The output from the pump 18 provides filtered power liquid which is derived from hot brine delivered from the well and which is returned to the well at substantially the same temperature as received from the well. This power liquid is used for driving a turbine to be described. Diversion of a proportion of the hot brine in advance of the heat exchanger returns as much heat as possible to the well and, therefore, reduces the tendency to cool the hot brine that is delivered from the well and which goes to the heat exchanger.

Figure 2:
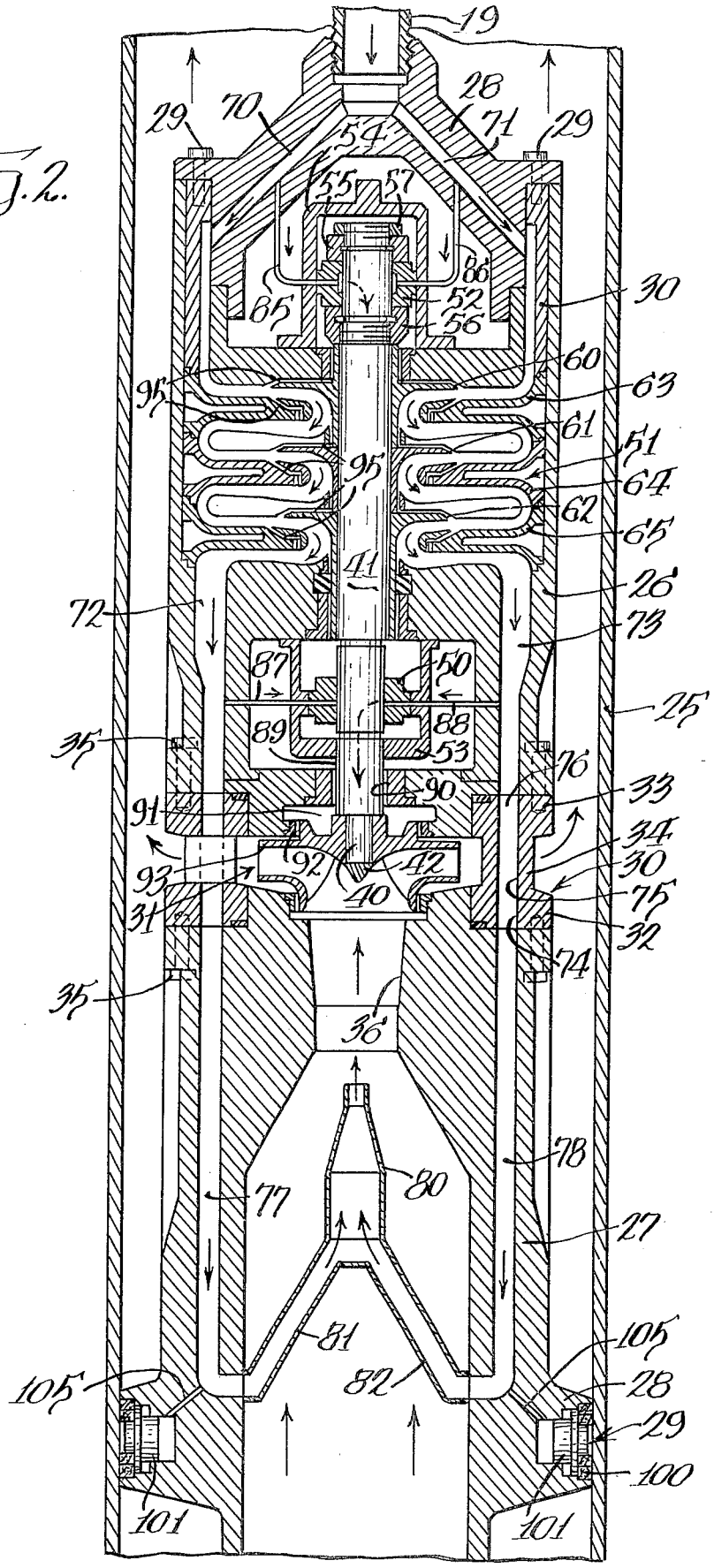
FIG. 2 is a central longitudinal section through the down hole pump and shown positioned in a well casing.

The down hole pump is shown in operative position in FIG. 2 within the tubular well casing 25.

A pump housing has two primary tubular sections 26 and 27 arranged generally in end-to-end relation and positioned at a distance from the inner surface of the well casing. The housing section 26 has one end closed by an end cap 28 and which is attached by a plurality of bolts 29 to an annular member 30 fitted within and secured to the inner wall of the tubular section 26. The housing section 27 has an annular flange 28 adjacent its lower end with a peripheral groove mounting casing seal structure indicated generally at 29 and which is expansible when the pump is in use to seal off the well casing at the location of the casing seal. A pump outlet is located thereabove whereby the well casing is used as the flow channel for delivery of pumped liquid from the well.

The casing sections 26 and 27 have their adjacent ends spaced from each other by a diffuser, indicated generally at 30, and which surrounds a rotatable pump impeller, indicated generally at 31. The diffuser has a pair of annular elements 32 and 33 which are spaced from each other and integral with a multiplicity of ribs or spokes 34 which permit liquid delivered by the pump impeller 31 to flow between the diffuser rings 32 and 33 to the interior of the well casing for delivery to the ground surface. This flow is indicated by arrows in FIG. 2. The pump is connected together by positioning of the housing sections 26 and 27 against the adjacent annular rings of the diffuser and a series of bolts 35 passed therethrough to hold the parts in assembled relation.

The lower end of the pump housing section 28 has a central passage leading to an inlet passage 36 for the pump and with rotation of the pump impeller 31 delivering the liquid under pressure to a pump outlet defined by the diffuser for delivery to ground surface. The pump impeller may be of a known type and be constructed as shown in Onal U.S. Pat. No. 3,817,653.

The pump impeller 31 is removably fastened to a reduced diameter lower end 40 of a driven pump shaft 41 by an attaching bolt 42. With the structure as described, it will be apparent that removal of the bolts 35 frees the diffuser for replacement by another diffuser and also provides access to the impeller 31 whereby it may be replaced. This results in simple modification of the characteristics of the pump merely by separating the pump housing at the location of the diffuser and pump impeller.

The pump shaft 41 is rotatably mounted in a pair of journal bearings and with pressure lubrication thereof in order to avoid the use of packings or mechanical seals which would be destroyed by solids in the hot brine. A lower shaft journal 50 is located between the pump impeller 31 and a motor for driving the pump impeller and indicated generally at 51. An upper shaft journal 52 is located above the motor 51. The lower shaft journal 50 is carried by a cup-shaped member 53 positioned within an interior chamber in the housing section 26 and secured to a wall thereof. The upper shaft journal 52 is fastened to a cup-shaped member 54 positioned within a chamber provided between the end cap 28 and the annular member 30. The cup-shaped member 54 is secured to a wall of the annular member 30 whereby the upper shaft journal 52 is held against movement in a direction axially of the shaft 41. Axial thrust of the shaft 41 is absorbed in both directions by the upper journal 52 by means of a pair of collars 55 and 56 which are secured to the upper end of the shaft 41 and are adjacent the opposite edges of the upper shaft journal 52 with a relatively small clearance. The collar 55 is held to the shaft 41 by a threaded nut 57 and the lower collar 56 is threaded onto a threaded section of the shaft 41. The absorption of axial thrust in both directions by the upper shaft journal 52 results in there being no thrust on the lower shaft journal 50.

The motor 51 is defined by a multi-stage turbine having impellers 60, 61, and 62 in the successive stages which are keyed to the drive shaft 41 for the pump. The lower end of the annular member 30 as well as additional structural members 63, 64, and 65 define turbine diffuser channels coacting with the impellers 60, 61 and 62 of the three stages for receiving power liquid and providing powered rotation of the shaft 41 to drive the pump impeller 31.

The power liquid returning to the well through line 19, as shown in FIG. 1, enters the end cap 28 at the upper end of the housing and passes through passages 70 and 71 to the first stage impeller 60 and for flow through the subsequent stages, as indicated by arrows, to a turbine outlet having passage means in the form of a pair of passages 72 and 73. The passage means 72 and 73 include portions in the upper casing section 26 as well as portions through the diffuser rings 32 and 33 as well as the diffuser ribs 34 as identified at 74, 75, and 76, with further sections of said passage means being provided in lower casing section 27 and indicated at 77 and 78. The spent power liquid is delivered to a suction ejector 80 located adjacent the inlet 36 to the pump and with the suction ejector including tubular elements 81 and 82 connecting with the passage sections 77 and 78, respectively. The suction ejector provides sufficient pressure at the pump inlet to assure a pressure which will prevent flashing.

The power liquid is used for lubricating the shaft journals 50 and 52, with branch passage means 85 and 86 connecting with the passages 70 and 71 in the end cap 28 and including passages leading to the interior of the upper shaft journal 52. A part of the spent power liquid is delivered from the passage sections 72 and 73 in the upper casing section 26 to the interior of the lower shaft journal 50 by branch passages 87 and 88 formed by openings through solid components including the cup-shaped member 53 as well as tubular members spanning the chamber provided interiorly of the casing section. The lubricating flow from the upper and lower shaft journals moves downwardly along the shaft 41 and passes through an oversize opening 89 in the cap 53 and a similar oversize opening 90 to enter into a chamber 91 adjacent the lower end of the shaft 41. This chamber has flow passages 92 communicating with the back face of a radial plate 93 forming part of the pump impeller 31 whereby a pressure gradient is caused by the pumping action of the back face of the impeller for withdrawing fluid from the chamber 91.

The turbine motor 51 is self-lubricated by power liquid by flow thereof between the impellers 60–62 and adjacent fixed components by passage spaces 95 therebetween.

Figure 3:
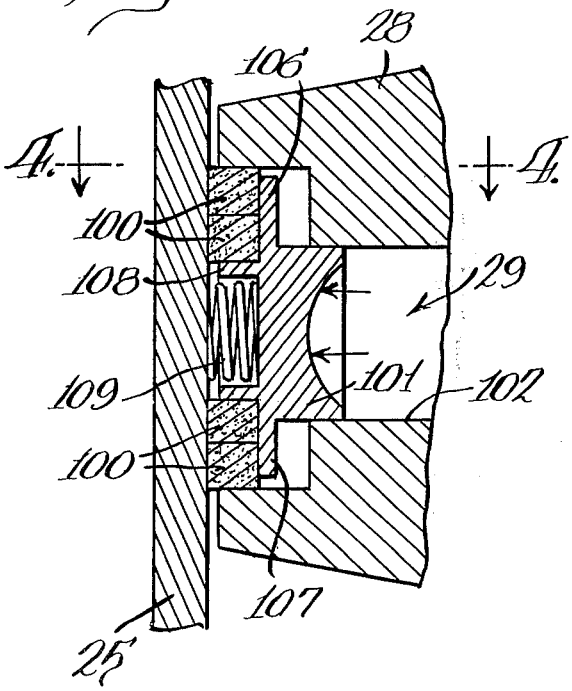
FIG. 3 is a fragmentary enlarged view of the lower left part of FIG. 2.
Figure 4:
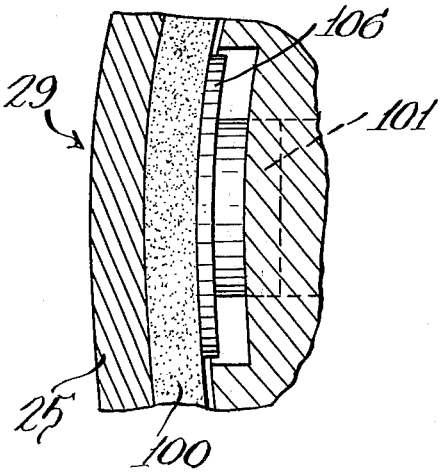
FIG. 4 is a view taken along the line 4—4 in FIG. 3.

The casing seal 29 is shown more particularly in FIGS. 3 and 4. The casing seal has a plurality of elastic rings 100 of a material, such as asbestos, which have an external diameter less than the internal diameter of the well casing whereby the pump housing may be freely inserted into the well casing to the desired depth. When in position, the seal is expandable into close contact with the well casing wall by means of a plurality of radially disposed, generally cylindrical plungers 101 equally angularly disposed around the internal periphery of the elastic rings 100. One unit is shown in FIGS. 3 and 4 with the cylindrical plunger 101 mounted in a cylindrical opening 102 in the annular flange 28 of the lower casing section 27. The opening is supplied with spent power liquid from passages 77 and 78 by branch passage means 105 with there being a branch passage leading to each of the openings 102. Each of the plungers 101 has oppositely-extending arcuated flanges 106 and 107 with each flange underlying two of the elastic rings 100, respectively, and with the curvature corresponding to that of the well casing wall whereby when spent power liquid flows through the passages 105, the plungers 101 are urged outwardly to expand the elastic rings 100 into contact with the well casing.

Each of the plungers 101 has an outer annular wall 108 mounting a spring 109 which may engage the well casing 25 during insertion of the pump to assure that the plungers 101 are held in a retracted position and do not urge the elastic rings 100 outwardly.

In operation of the pump, the pump impeller 31 coacts with the surrounding diffuser to deliver hot brine at a relatively high temperature to ground surface with part of the pumped fluid being returned through the line 19 to power the turbine and to perform the other described functions including lubricating of the shaft, delivering spent power liquid to the suction ejector at the pump inlet and maintaining the casing seal operative. As an example and not limiting the disclosure, assuming the down hole pump is at a depth to obtain access to the geothermal water or hot brine at 650° F., the pump has a discharge pressure of approximately 2900 p.s.i. The specific capacity of the pump in terms of flow, speed, and head, may vary widely with widely varying conditions encountered in brine solutions and surrounding reservoir characteristics. The power liquid returned to the turbine at some temperature slightly reduced from that delivered from the well is returned to the turbine at approximately 2150 p.s.i. and at a flow of 400 gallons per minute, for example. The spent power liquid is discharged from the turbine at approximately 750 p.s.i. and delivered to the suction ejector 80 whereby approximately 750 p.s.i. pressure is added to inlet pressure to establish a net positive suction head and prevent cavitation. The avoidance of cavitation results in avoiding localized flashing which avoids the precipitation out of solids from the hot brine and making oxygen available for oxidation. The liquid pressures in the system are sufficiently high to be above the vapor pressure of the hot brine and, therefore, the brine is kept in a liquid state at all times.

I claim:

1. A method of deep well pumping of liquid comprising, placing a turbine driven pump at the desired depth in a well casing and sealing the pump to the well casing in a seal area with a pump inlet communicating with the liquid in the well and a pump outlet communicating with the well casing above the seal area for delivery of pumped liquid to the surface using the well casing as a conduit, returning a predetermined proportion of the pumped liquid from the surface under pressure to provide power liquid for driving said turbine, filtering of said predetermined proportion of pumped liquid prior to return thereof, directing some of said returned filtered liquid in advance of said turbine to bearings for the turbine driven pump to provide lubrication thereof, and delivering said power liquid exhausted from the turbine to the pump inlet area in a manner to provide a net positive suction head and prevent cavitation.

2. A method as defined in claim 1 including directing some of said returned filtered liquid to a seal device in the seal area to establish a pressure actuated firm seal with the well casing.

3. A method as defined in claim 1 wherein utilization of said pumped liquid includes passage thereof through a heat exchanger at the surface, and removing said predetermined proportion of liquid from the pumped liquid in advance of said heat exchanger to minimize loss in heat content thereof, and passing said last-mentioned liquid through a pump prior to return to the turbine driven pump to place the liquid under pressure.

* * * * *